US006321632B1

(12) United States Patent
Holmes et al.

(10) Patent No.: US 6,321,632 B1
(45) Date of Patent: Nov. 27, 2001

(54) THREE POSITION BIPOD SUPPORT FOR THE CARRIER MOUNTED 120 MM MORTAR

(75) Inventors: Edward William Holmes, Valley Falls; George E. Hathaway, IV, Loudonville; Carlos I. Gutierrez, Troy, all of NY (US)

(73) Assignee: The United States of America as represented by Secretary of the Army, Washington, DC (US)

( * ) Notice: Subject to any disclaimer, the term of this patent is extended or adjusted under 35 U.S.C. 154(b) by 0 days.

(21) Appl. No.: 09/631,141

(22) Filed: Aug. 2, 2000

(51) Int. Cl.[7] ..... F41F 1/06
(52) U.S. Cl. ..... 89/37.05; 89/37.01
(58) Field of Search ..... 89/1.35, 37.02, 89/37.03, 37.05, 40.01, 40.03, 40.02, 40.08

(56) References Cited

U.S. PATENT DOCUMENTS

| | | | | |
|---|---|---|---|---|
| 2,977,858 | * | 4/1961 | Jasse | 89/41 |
| 3,745,879 | * | 7/1973 | Asikainen et al. | 89/37 C |
| 4,012,986 | * | 3/1977 | Germershausen et al. | 89/17 |
| 4,721,026 | * | 1/1988 | Ibarra | 89/37.05 |
| 4,724,740 | * | 2/1988 | Garcia | 89/37.05 |
| 5,531,150 | * | 7/1996 | Gegarian et al. | 89/15 |

FOREIGN PATENT DOCUMENTS

| | | | | |
|---|---|---|---|---|
| 561549 | * | 10/1957 | (BE) | 89/37 C |
| 70195 | * | 2/1941 | (CZ) | 89/37.05 |
| 0075634 | * | 4/1983 | (EP) | 89/37.05 |
| 0187634 | * | 7/1986 | (EP) | F41F/17/00 |
| 570613 | * | 1/1924 | (FR) | 89/37.05 |

* cited by examiner

*Primary Examiner*—Michael J. Carone
*Assistant Examiner*—Gabriel S Sukman
(74) *Attorney, Agent, or Firm*—John F. Moran; Michael Sachs

(57) ABSTRACT

A bipod support apparatus for an indirect fire weapon such as the 120 mm mortar comprised of a 55 degree ramp and a longer travel distance between the low, middle and high positions which allows for the mounting of the bipods buffer mechanism to the 120 mm mortar tube to stay in one location at 15.54 inches from the muzzle end of the mortar tube, throughout all the adjustment positions and elevation ranges (800 mils to 1512 mils). The three positions, in lieu of the current two position system, eliminate the constant changing of elevation adjustment positions. The new elevating support assembly with its new guide assembly allows for a smooth motion/transition between the three positions of the main base assembly. A new locking mechanism rotates a quarter turn (90°) to lock or unlock the elevating support assembly. Such lock or unlock action now only requires a one hand operation to unlock-lift-lock the elevating support assembly.

6 Claims, 9 Drawing Sheets

THREE POSITION BIPOD SUPPORT FOR THE CARRIER MOUNTED 120 MM MORTAR

U.S. GOVERNMENT INTEREST

The inventions described herein may be manufactured, used, or licensed by or for the U.S. Government for U.S. Government purposes.

BACKGROUND OF THE INVENTION

I. Field of Invention

This invention applies to the field of systems and of apparatus which support a military indirect (e.g. mortar, etc.) weapon and allow for the quick adjustment in elevation. In particular, a bipod support is provided which is employed with the indirect weapon such as the 120 mm M121 Mortar fielded inside a personnel weapons carrier, such as the mechanized tracked carrier M1064.

II. Background of Invention

The current 120 mm mortar is not able to be operated efficiently because to be effectively operated, an operator must constantly make elevation adjustments. Moreover, due to the mortar's inherent recoil, it is difficult to keep the mortar in one location throughout the various normal adjustment positions and elevation ranges projected based upon experience during combat firing missions.

The above cited problems have existed since the mortar was fielded in 1992. The current bipod support operates on a two position pivotal system, with an existing elevating mechanism 20 as shown by FIG. 1.

At FIGS. 1, 2, 3 the current bipod support 1 is angled at 45 degrees and has two elevation adjustment positions, low 2*a* and at FIG. 2, high 2*b*. These positions are basically coarse elevating adjustments. In order to achieve elevation ranges 800 mils to 1512 mils, three individual adjustments have to be made. These are achieved by a. Pivoting the elevating Mechanism 20 to either the low 2*a* position at FIG. 1 or high 2*b* position at FIG. 2 of the bipod support 1 also shown at FIG. 3.

b. Cranking the elevating Mechanism 20 on bipod between its minimum 3*a* and maximum 3*b* elevating extremes as shown at FIG. 1.

c. Sliding the buffer mechanism 4 on mortar tube 5 between 15.54 inch location and stop 6, to adjust for the additional elevation that the current bipod support 1 does not provide as shown at FIGS. 1, 2.

This is time consuming with too many variables, particularly since the most common elevation ranges are between 980 mils to 1245 mils.

This causes the gunner (soldier) to be adjusting the current bipod support 1 from the low position 2*a* with elevating mechanism 20 near the maximum elevation extreme 3*b* and buffer mechanism 4 dose to or at the stop 6, then change to high position 2*b* with elevating mechanism 20 near minimum elevation extreme 3*a* and buffer mechanism 4 dose to or at 15.54 inch location, and back again. This makes for a lot of adjustments for small elevation changes.

Accordingly it is an object of the invention to allow the mounting of the bipods buffer mechanism 4 to the 120 mm mortar tube 5 to stay in one location, at 15.54 inches from muzzle end of mortar tube 5, throughout all the adjustment positions and elevation ranges (800 mils to 1512 mils).

Still another object of this invention is to eliminate constant changing of elevation adjustment positions.

Yet, another object of this invention is to allow for a smooth motion/transition between positions.

Moreover, another object of this invention is to allow for a one-hand operation to unlock-lift-lock the elevating support assembly.

Finally, another object of this invention is allow for a faster reaction time between position and elevation range adjustments.

Other objects will appear hereinafter.

SUMMARY OF THE INVENTION

It has now been discovered that the above and other objects of the present invention may be accomplished in the following manner.

Specifically, the invention eliminates a number of steps from the existing fielded design and uses the middle position for the most commonly used ranges, thus cutting down on adjustments. In particular, a new bipod support is provided with a 55 degree ramp and a longer travel distance between the low, middle to high positions which allows for the mounting of the bipods buffer mechanism to the 120 mm Mortar tube to stay in one location, at 15.54 inches from the muzzle end of the mortar tube, throughout all the adjustment positions and elevation ranges (800 mils to 1512 mils).

The three positions on a new bipod support eliminate the constant changing of elevation adjustment positions. The middle position encompasses the most commonly used elevation ranges, 980 mils to 1245 mils. There is only a seven (7) to ten (10) mil overlap between positions.

A new guide assembly allows for a smooth motion/transition between positions.

A new locking mechanism rotates a quarter turn (90 degrees) to lock or unlock the elevating support assembly. This only now requires a one-hand operation to unlock-lift-lock the elevating support assembly.

The principals of kinematics were applied to determine the design of the 55 degree ramp and the locations of the three positions on the new bipod support. The method of construction is not novel to the design; however durability of the mechanism is to be tailored to the usage and advice of the user.

BRIEF DESCRIPTION OF THE DRAWINGS

For a more complete understanding of the invention, reference is hereby made to the drawings which.

DETAILED DESCRIPTION OF PREFERRED EMBODIMENTS

Figure 4:
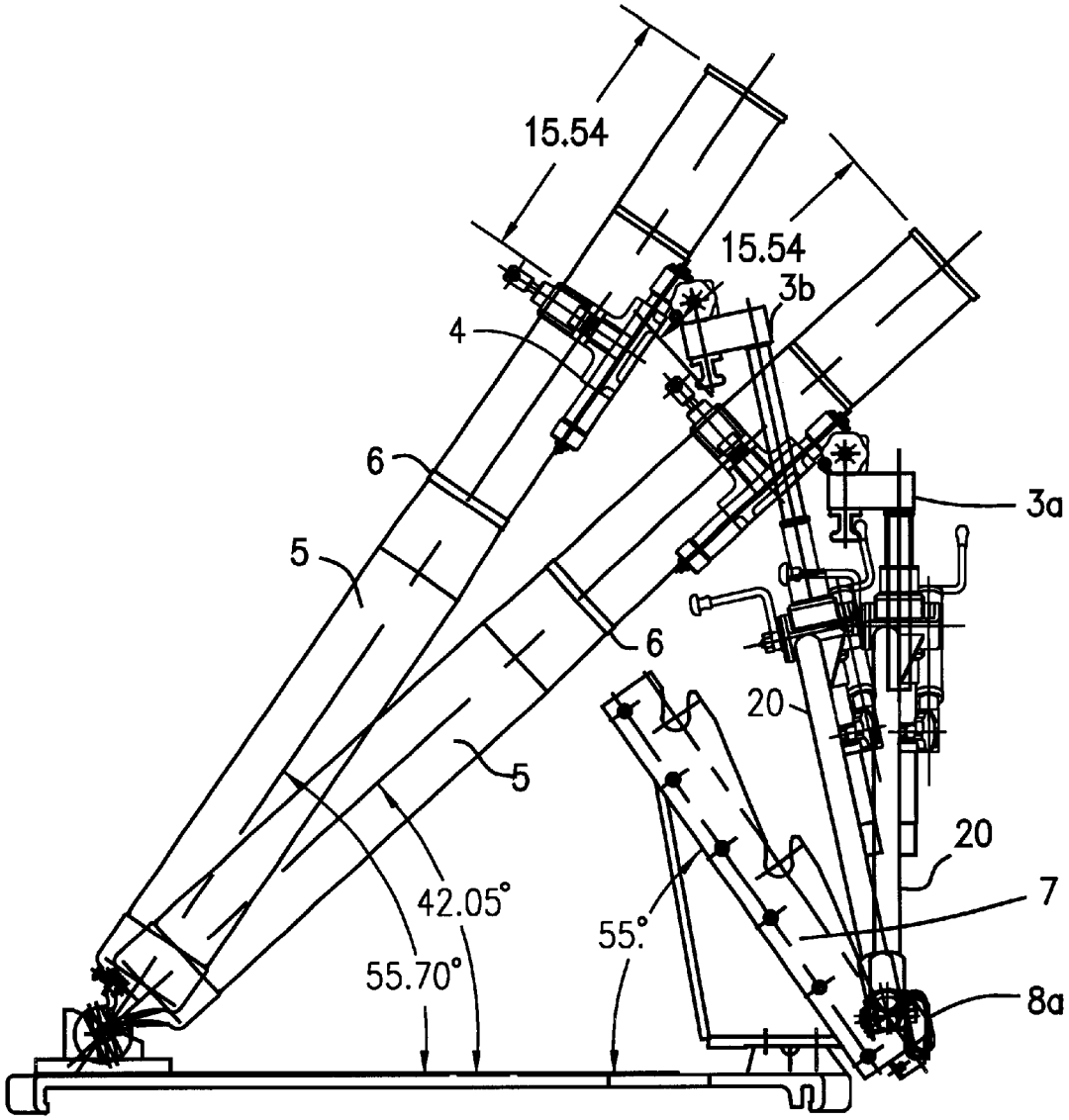
FIG. 4 is a diagram of the new bipod support design, with its 55.00° ramp, showing the low position, minimum and maximum extreme.
Figure 5:
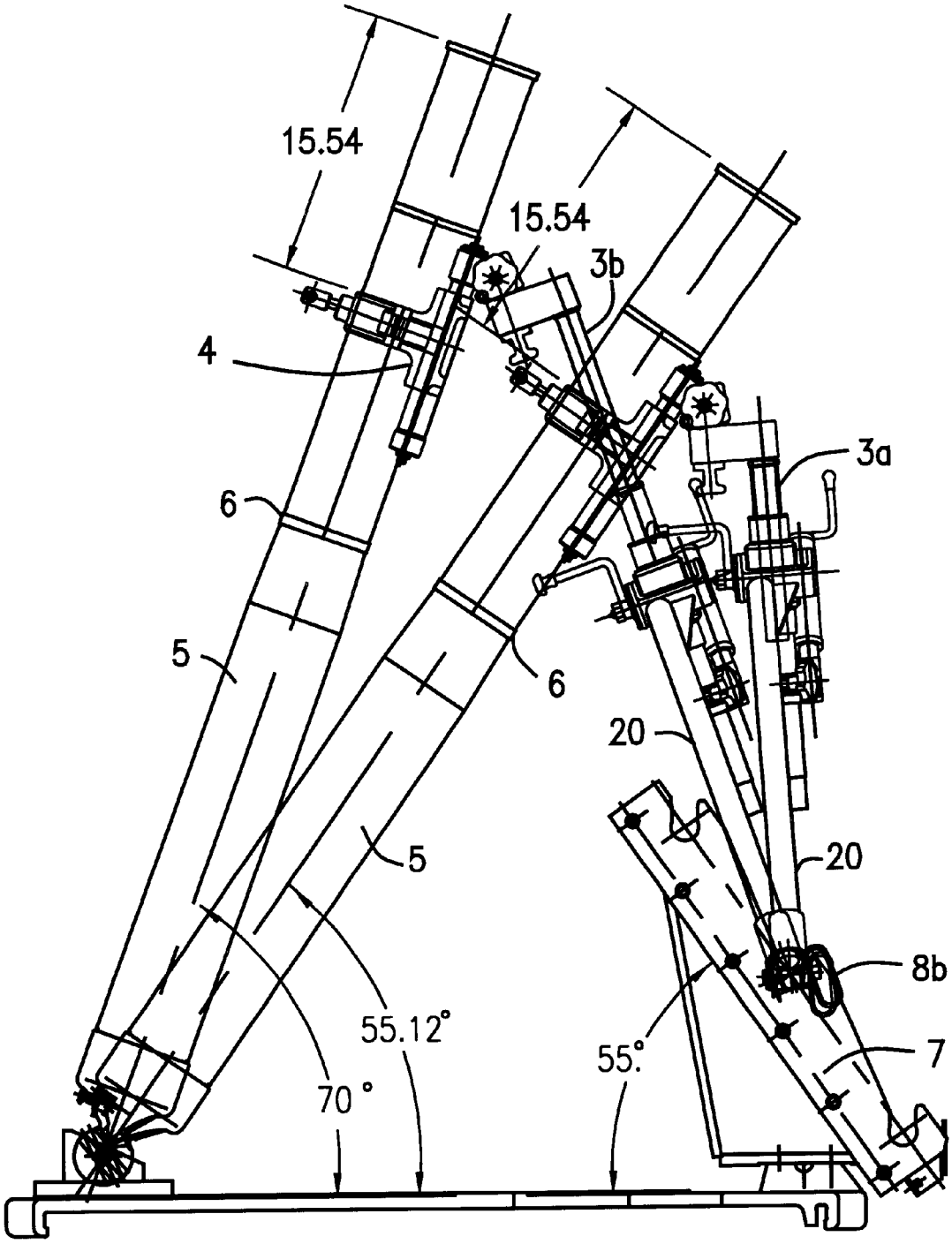
FIG. 5 is a diagram of the new bipod support design, with its 55.00° ramp, showing the middle position, minimum and maximum extremes.
Figure 6:
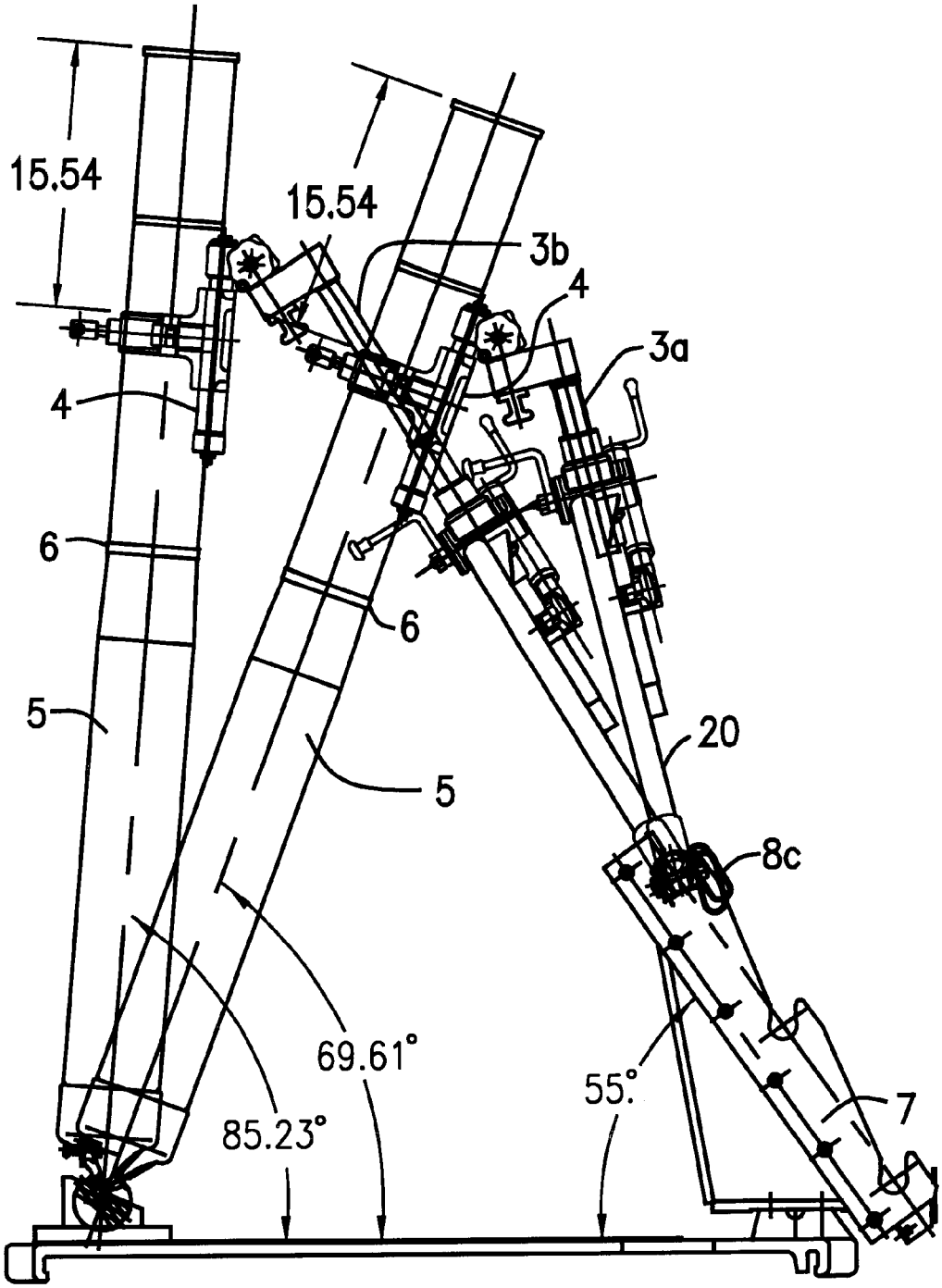
FIG. 6 is a diagram of the new bipod support design, with its 55.00° ramp, showing the high position, minimum and maximum extremes.

FIG. 4 depicts the new bipod support 7. This bipod support 7 has a 55 degrees ramp. The bipod support 7 provides a slightly longer travel distance from the low position 8*a* shown at FIG. 4 to the middle position 8*b* of FIG. 5 and to the high position of FIG. 6. This design allows the mounting of the buffer mechanism 4 to the 120 mm Mortar tube 5 to stay in one location, at 15.54 inches from the muzzle end of the mortar tube 5 throughout all the adjustment positions and elevation ranges, 800 to 1512 mils. The three positions 8*a,* 8*b,* 8*c* at FIGS. 4, 5, 6 respectively on the bipod support 7 eliminate constant changing of elevation adjustment positions. There is only a 7 to 10 mil overlap between positions 8*a,* 8*b,* 8*c*. The low position 8*a* encompasses the ranges between 747.5 mils to 990.2 mils or 42.05° to 55.70°. FIG. 5 shows the middle position 8*b* on the bipod support 7. This middle position 8*b* encompasses the most commonly used elevation ranges of 980 mils to 1245 mils or between 55.12° to 70.00°. FIG. 6 shows the high position 8*c* on the bipod support 7. This high position encompasses the elevation ranges 1237.5 mils to 1515.2 mils or 69.61° to 85.23°.

Figure 7B:
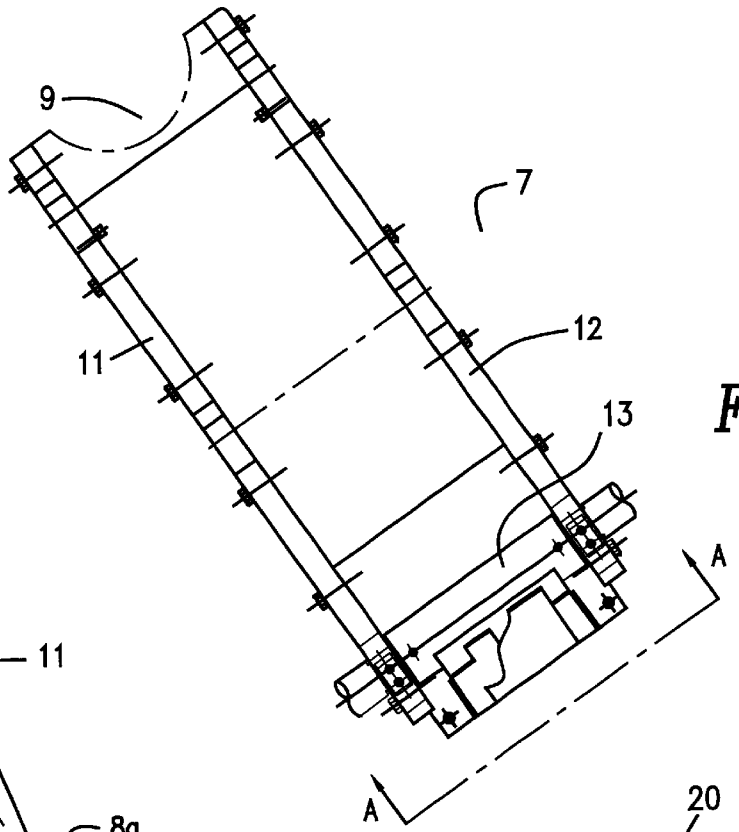
FIG. 7B is a diagram of the main base assembly of the new 55° bipod support assembly showing the right rack support as well as the left rack support. Section A—A is a view taken from FIG. 7C.
Figure 7C:
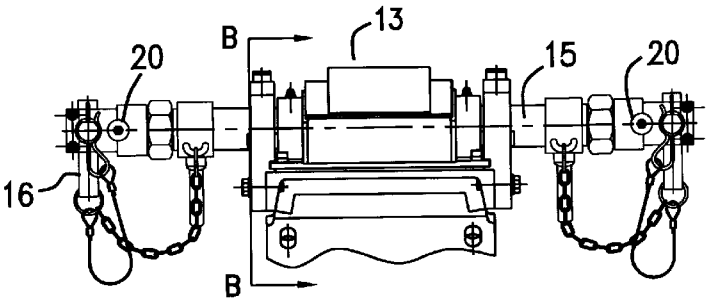
FIG. 7C is a cross-sectional diagram of the elevating support assembly. Section B—B is a view taken from FIGS. 8A and 8B.
Figure 7A:
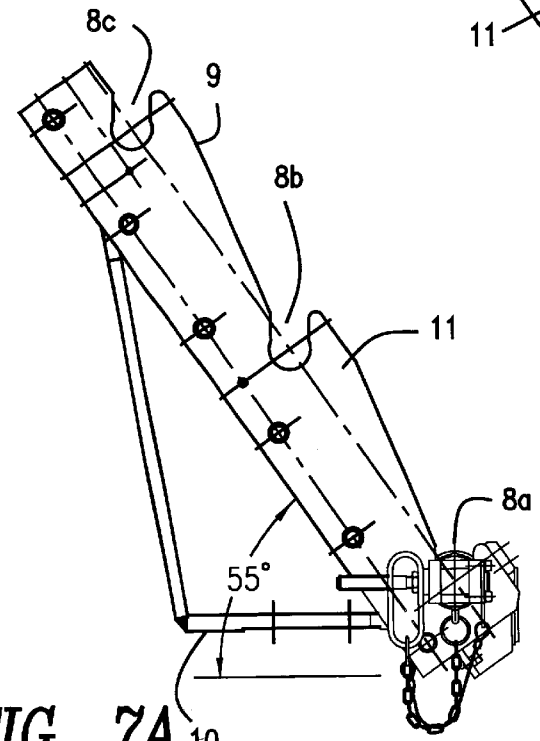
FIG. 7A is a diagram of the main base assembly of the new 55° bipod support assembly showing the mounting base bipod and the left rack support.

FIGS. 7A and 7B depict in expanded detail the bipod support 7 which includes the main base assembly 9. The main base assembly 9 comprises the mounting base bipod 10, the rack support, left 11 and the rack support, right 12. FIG. 7A closely shows the 55 degree ramp feature of the main base assembly 9 with the three individual positions which allow for the quick positioning of the bipod mount.

Figure 2:
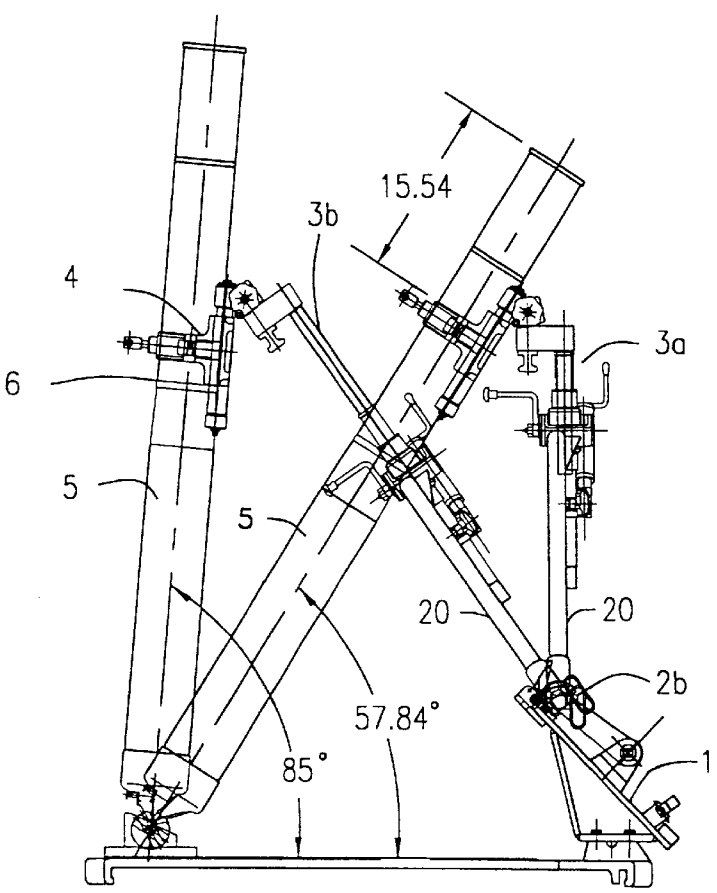
FIG. 2 (PRIOR ART)
FIG. 2 is a diagram of the current bipod support design, showing the high position, minimum, maximum extremes.
Figure 1:
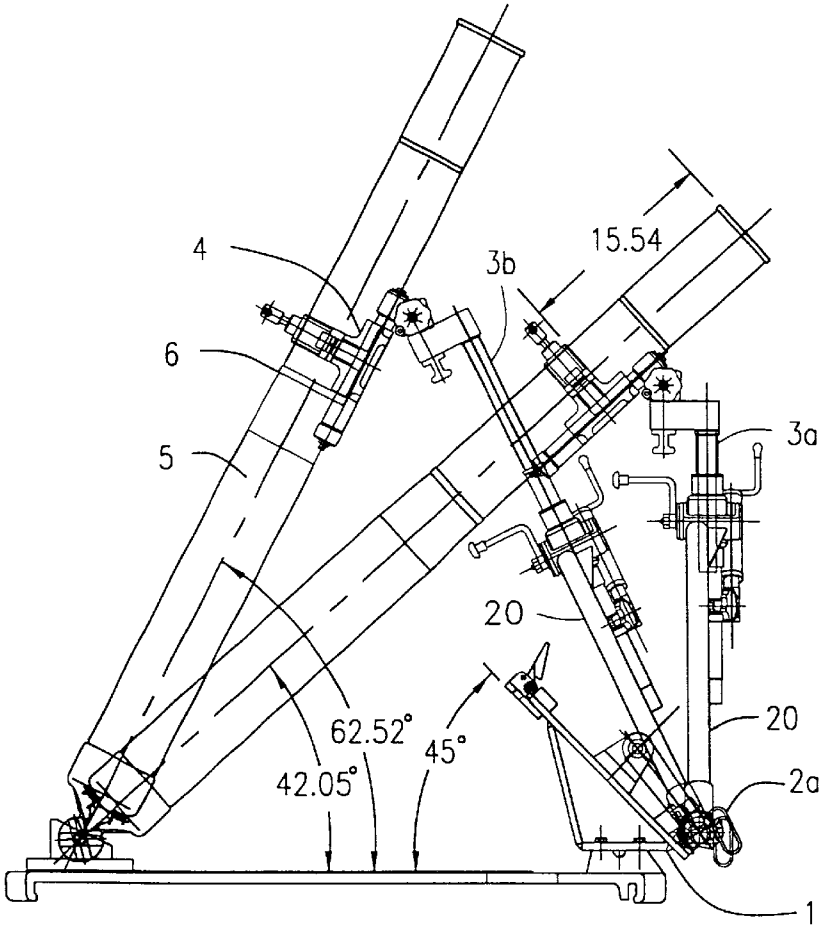
FIG. 1 (PRIOR ART)
FIG. 1 a is diagram of the current bipod support design, showing the low position, minimum and maximum extremes.
Figure 3:
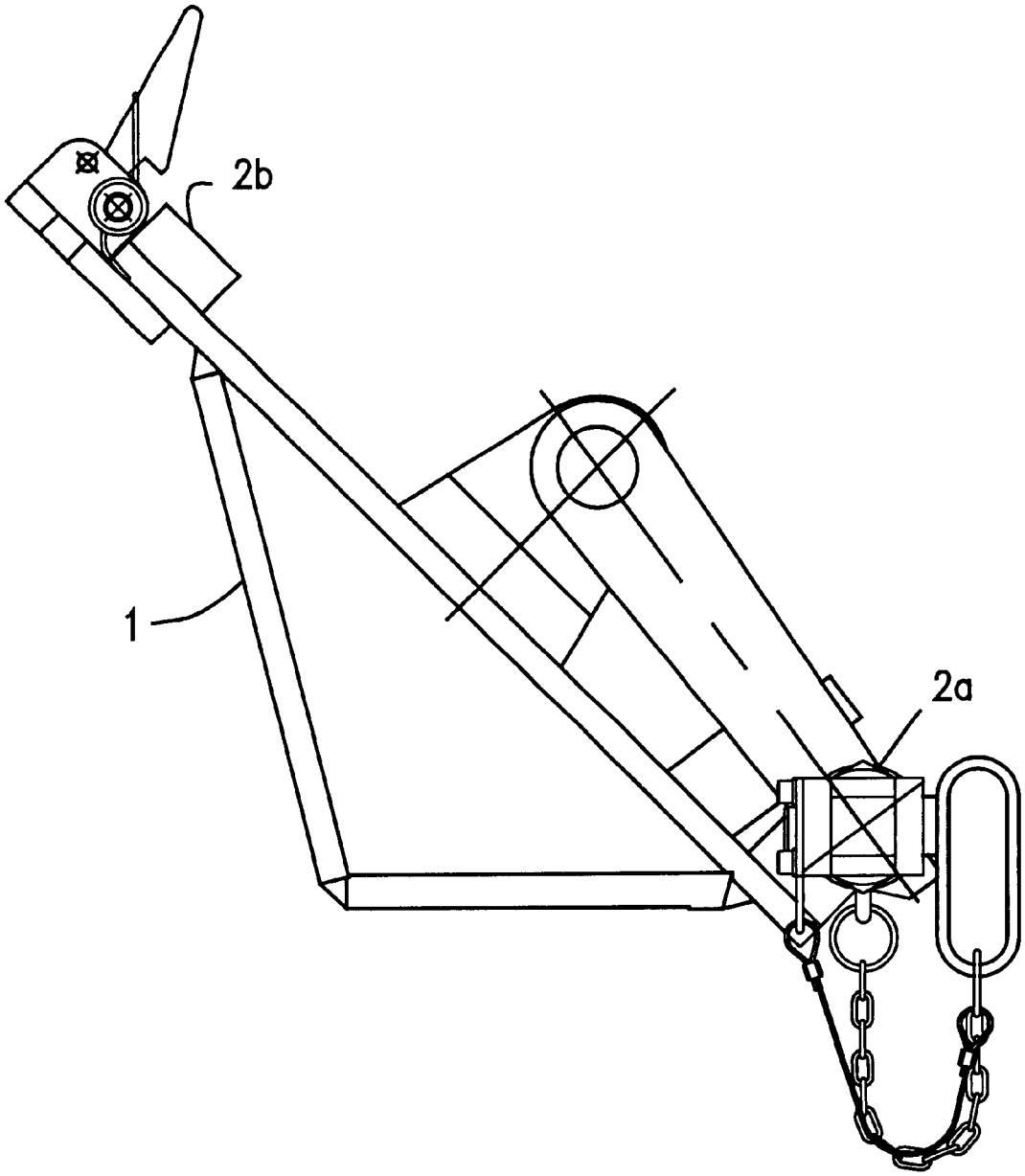
FIG. 3 (PRIOR ART)
FIG. 3 is a diagram of the current 45° bipod support assembly.
Figure 8B:
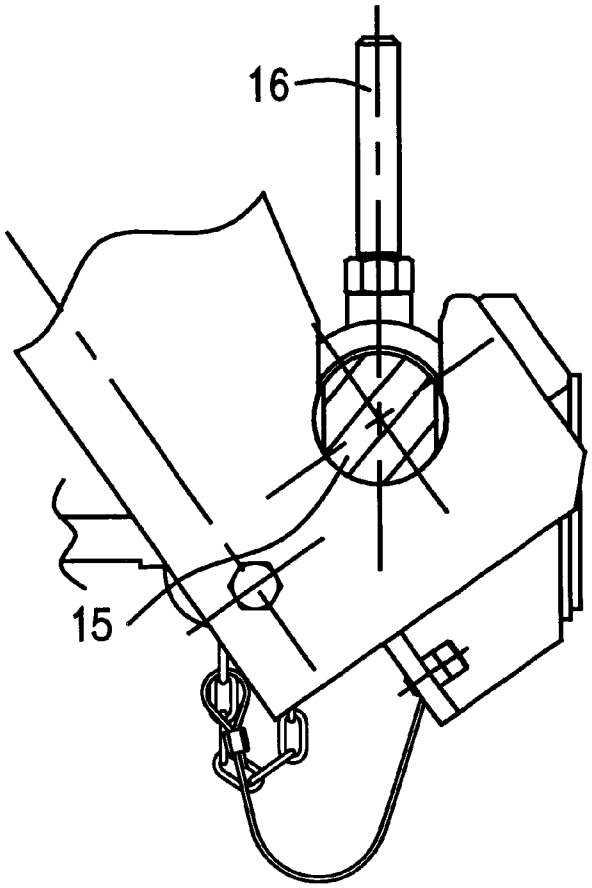
FIG. 8B is a cross-section view of the unlocked position of the bar support.
Figure 8A:
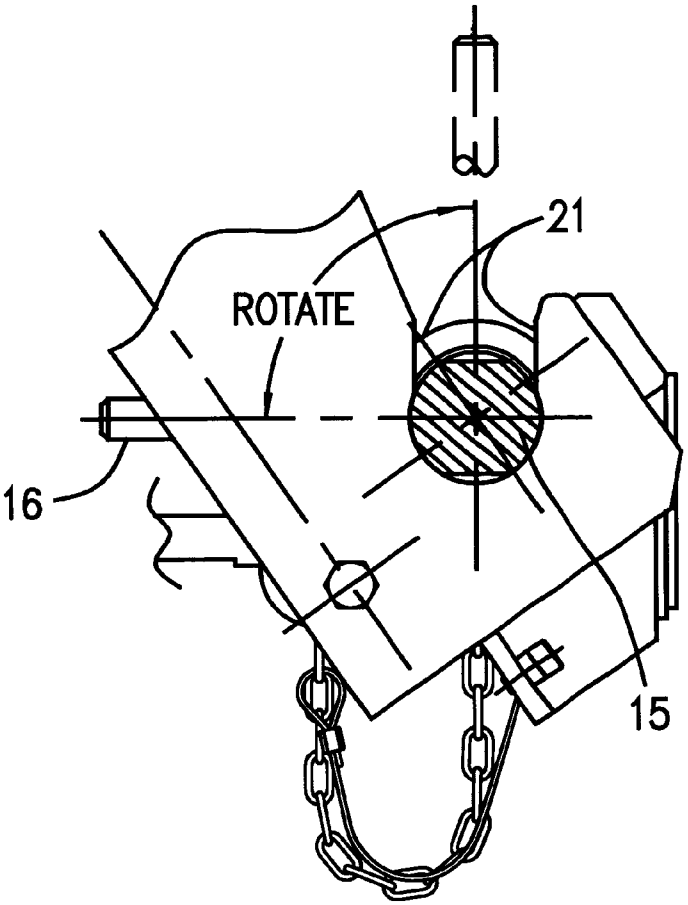
FIG. 8A is a cross-section view of the locked position of the bar support.
Figure 9A:
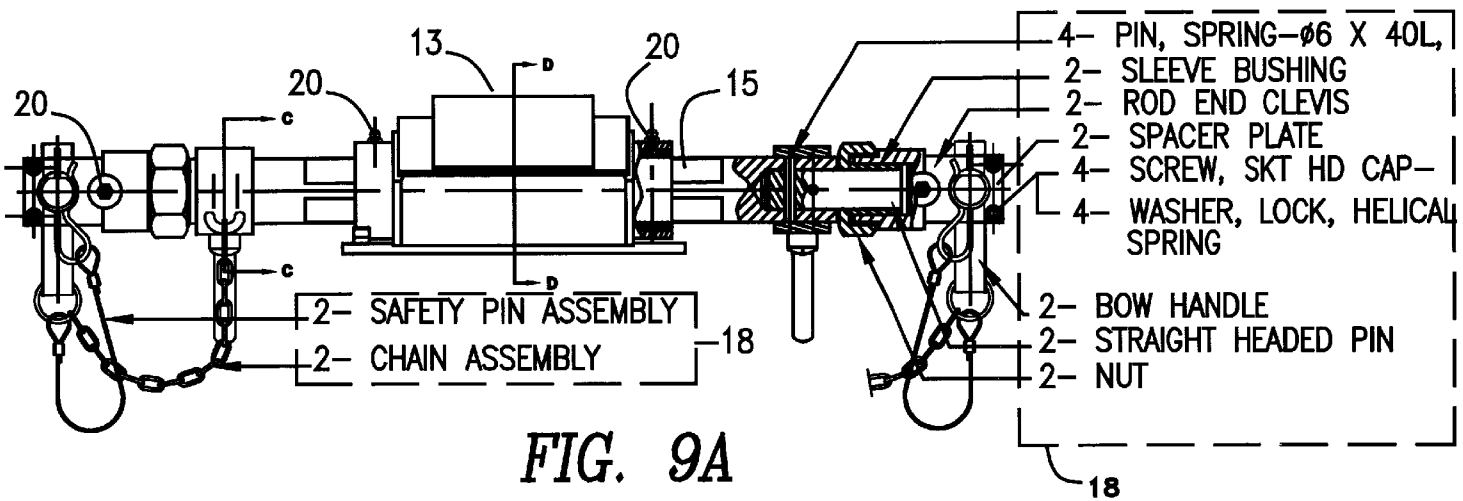
FIG. 9A is a side view of the entire elevating support assembly. Section C—C is a view taken from FIG. 9B. Section D—D is a view taken from FIG. 9C.

FIG. 7C depicts the elevating support assembly 13 which locks the existing bipod mount legs to the ends of the guide assembly 13, comprised of an assortment of components 18 used from the current design shown at FIG. 9A. This insures a clear interface transition between the current bipod support 1 design at FIGS. 1, 2, 3 and new bipod support 7 design at FIGS. 4, 5, 6, 7, 8, 9A, 9B, 9C. In particular, FIGS. 9A, B, C show that the elevating support assembly 13 comprises a guide assembly 14, the bar support 15, a handle assembly 16, a threaded pin 17, various components from the current design 18, a hinge 19 and grease fittings 20.

Figure 9C:
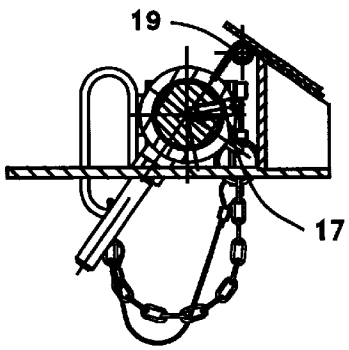
FIG. 9C is a cross-section view of the threaded pin.
Figure 9B:
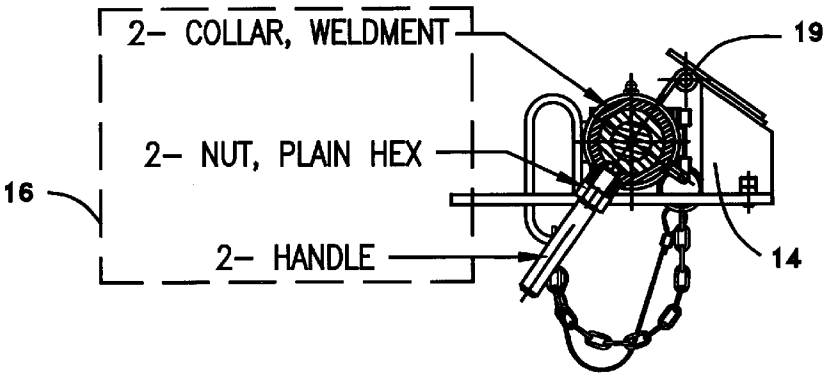
FIG. 9B is a cross-section view of the handle assembly.

At FIG. 9B, the guide assembly 14 with integral hinges 19, allows the bar support 15 shown at FIG. 9A to maintain alignment with smooth action. The guide assembly 14, while extended, slides along a machined groove in components 11, 12 shown at FIGS. 7A and 7B, between the three individual locking positions in the main base assembly 9. The handle assembly 16 is used for rotating the bar support 15, for locking or unlocking it from the three positions 8*a,* 8*b,* 8*c* on the main base assembly 9. Threaded pin 17 provides for a positive stop and aids in the precise alignment of the guide area 21 at FIGS. 8A and 8B, for the lock and unlock position. Grease fittings 20 shown at FIGS. 7C and 9A, are designed and, hence, located to prevent wear in the area of motions.

Sequence of Operation

FIGS. 4, 5, 6, 7A, B, C show the new bipod support 7 design. At FIGS. 7A, B, C on the new bipod support 7, the elevating support assembly 13 is locked into the low position 8*a*. Once locked therein, this elevation ranges between 800 to 990 mils as shown at FIGS. 4, 7A, B, C.

Using FIGS. 7A, B, C and FIGS. 8A, B if a higher elevation is required, one rotates the handle 16, on the bar support 15 to the up position. This action unlocks the elevating support assembly 13 from the main base assembly 9. Thereafter, one grabs the bar support 15 and lifts up, through the guide area 21, and out of the low position 8*a*. FIGS. 9B, 9C which show this action allows the hinge 19 on the guide assembly 14 to pivot to a vertical position, and keeps the bar support 15 aligned as the captured guide assembly 14 slides up the 55 degree ramp as shown at FIGS. 5, 6.

Using FIG. 5, one may slide the elevating support assembly 13 to the middle position 8*b* by lowering said assembly 13 shown at FIG. 7B through the guide area 21 shown at FIG. 8A until it comes to rest. Then one can rotate the handle 16 on the bar support 15 down. This latter action relocks the elevating support assembly 13 to the main base assembly 9, so that it does not jump out while firing the mortar. The elevation ranges in this middle position 8*b* are 980 to 1245 mils.

Using FIG. 6, to achieve higher elevation ranges, one can repeat the above steps to bring the elevating support assembly 13 to the high position 8*c*. The elevation ranges for the high position are 1237 to 1515 mils.

Figure 10:
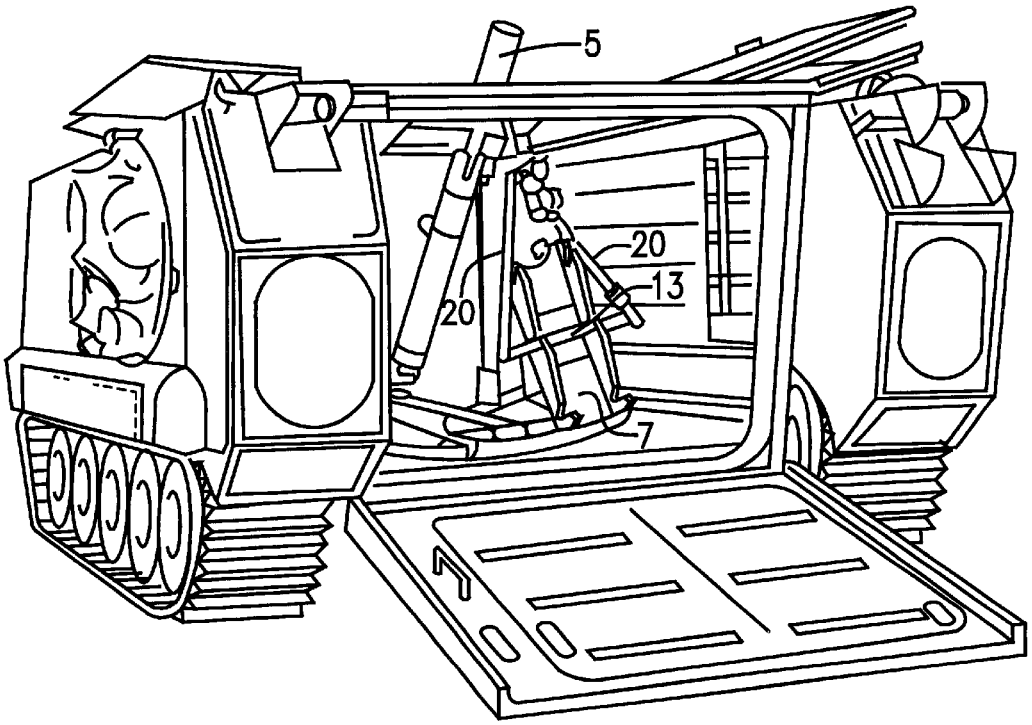
FIG. 10 is an artists' sketch of the 120 mm mortar, M121 System with the three position bipod support assembly in the middle position mounted in the armored carrier M1064.

Likewise the reverse same procedures may be exercised to lower the elevating support assembly 13 down through the three positions. FIG. 10 is an artist's sketch of the 120 mm mortar 5, M121 System with the three position bipod assembly in the middle position 8*b* mounted in the armored carrier M1064.

Thus, it is apparent that in accordance with the present invention, a functional design that fully satisfies the objectives aims and advantages is set forth above. While the invention has been described in conjunction with a specific embodiment, it is evident that many alternatives, modifications and variations will become evident to those skilled in the art in light of the foregoing descriptions. Accordingly, it is intended that the present invention embrace all such alterations, modifications, and variations as fall within the spirit and broad scope of the appended claims.

What is claimed is:

1. A bipod support apparatus for an indirect fire weapon, which allows for the locking and unlocking of the elevating mechanism for faster times between position and elevation range adjustment, allowing the buffer mechanism of the mortar to remain in one location at 15.54 inches from the muzzle end of the mortar tube throughput all the adjustments of positions and elevation ranges, 800 to 1512 mils, comprising three distinct and predetermined positions on bipod support which eliminate the constant changing of elevation adjustment positions;

a means to allow for the smooth motion/transition between the three positions on bipod support;

a locking mechanism which locks and unlocks elevating support assembly by a one hand operation.

2. A bipod support apparatus, as in claim 1, wherein the three positions on bipod support are spaced on a 55° ramp comprising a low position, middle position, and high position.

3. A bipod support apparatus, as in claim 1, wherein the bipod support apparatus further comprises a 55° mainbase assembly which further comprises a mounting base bipod;

a rack support, left, and a rack support, right, into which elevating support assembly fits.

4. A bipod support apparatus, as in claim 1, wherein the means to allow for the smooth motion/transition of elevating mechanism between the three positions on bipod support is the elevating support assembly.

5. A bipod support apparatus, in claim 4, wherein the elevating support assembly comprises a guide assembly to slide along the mechanical grooves of the rack support, for smooth transition between positions;

a bar support to maintain alignment;

a handle assembly for rotating the bar support for locking and unlocking it from the three positions of main base assembly;

a threaded pin to provide positive stop and aids in precise alignment of the guide area;

a hinge; and grease fittings to prevent wear on areas of motion.

6. A bipod support apparatus, as in claim 1, wherein the locking mechanism which locks and unlocks elevating support assembly by one hand operation is a handle assembly for rotating the bar support from the three positions of base assembly.

* * * * *